United States Patent [19]

Puentes-Bravo et al.

[11] Patent Number: 4,960,526

[45] Date of Patent: Oct. 2, 1990

[54] DIAMMONIUM COMPOUND CONTAINING FABRIC SOFTENING AND ANTISTATIC DETERGENT COMPOSITION

[75] Inventors: Eduardo Puentes-Bravo, Liege; Marcel Gillis, Argenteau; Andreas J. Somers, Tongeren, all of Belgium

[73] Assignee: Colgate-Polmolive Company, Piscataway, N.J.

[21] Appl. No.: 418,731

[22] Filed: Oct. 3, 1989

Related U.S. Application Data

[63] Continuation of Ser. No. 158,042, Feb. 16, 1988, abandoned, which is a continuation of Ser. No. 876,999, Jun. 27, 1986, abandoned, which is a continuation-in-part of Ser. No. 758,821, Jul. 25, 1985, abandoned.

[51] Int. Cl.[5] ..... C11D 1/62; C11D 3/30; D06M 13/332

[52] U.S. Cl. ..... 252/8.8; 252/8.6; 252/528; 252/547

[58] Field of Search ..... 252/8.6, 8.8, 528, 547

[56] References Cited

U.S. PATENT DOCUMENTS

| | | | |
|---|---|---|---|
| 3,862,058 | 1/1975 | Nirschl et al. | 252/8.6 |
| 3,886,075 | 5/1975 | Bernardino | 252/8.8 |
| 4,126,586 | 11/1978 | Curtis et al. | 252/524 |
| 4,196,104 | 4/1980 | Oguagha | 252/542 |
| 4,277,350 | 7/1981 | Minegishi et al. | 252/8.8 |
| 4,291,071 | 9/1981 | Harris et al. | 427/220 |
| 4,294,711 | 10/1981 | Hardy et al. | 252/8.8 |
| 4,338,204 | 7/1982 | Spadini et al. | 252/8.75 |
| 4,442,013 | 4/1984 | Fraikin et al. | 252/8.8 |
| 4,536,315 | 8/1985 | Ramachandran et al. | 252/174.11 |
| 4,561,998 | 12/1985 | Wertz et al. | 252/174.12 |
| 4,610,796 | 9/1986 | Chirash et al. | 252/547 |

FOREIGN PATENT DOCUMENTS

| | | |
|---|---|---|
| 61-152800 | 7/1986 | Japan . |
| 2164657 | 3/1986 | United Kingdom . |

*Primary Examiner*—Paul Lieberman
*Assistant Examiner*—Linda D. Skaling
*Attorney, Agent, or Firm*—Bernard Lieberman; Robert C. Sullivan; Murray M. Grill

[57] ABSTRACT

A water-soluble diammonium compound, such as N-methyl-N-(2-hydroxyethyl)-N-tallowalkyl-N'-methyl-N'-bis(2-hydroxyethyl)-propylene-diammonium methosulfate, is homogeneously and finely dispersed in a spray-dried detergent bead or granule. The spray-dried bead is blended with a clay mineral fabric softener. The final composition exhibits antistatic action even at low levels (e.g. less than 2%) of the antistat without adversely effecting softening, cleaning or whitening. In a typical formulation, the spray-dried beads include linear alkyl benzene sulfonate or other anionic surfactant, an inorganic polyphosphate and/or other inorganic and/or organic detergent builder salt, diammonium compound antistatic agent, and other heat stable and pH insensitive detergent additives and fillers. In addition to a smectite clay fabric softener, other post-added ingredients typically include a nonionic surfactant, enzyme, perfume, bleach, and other detergent additives which may be pH sensitive, heat sensitive, water-insoluble, or reactive with one or more of the components of the spray-dried beads.

5 Claims, No Drawings

DIAMMONIUM COMPOUND CONTAINING FABRIC SOFTENING AND ANTISTATIC DETERGENT COMPOSITION

This application is a continuation of application Ser. No. 158,042, filed Feb. 16, 1988 , now abandoned, which is a continuation of Ser. No. 876,999, filed June 27, 1986, now abandoned, which is a continuation-in-part of Ser. No. 758,821, filed July 25, 1985, now abandoned.

This invention relates to a laundry detergent composition based on clay softener and cationic antistatic agent. More particularly, this invention relates to a laundry detergent powder composition containing detergent surfactant, clay softener, and a water-soluble diammonium salt antistatic agent, to the method of preparing the composition and to the use thereof in laundering textile materials.

Powdery detergent compositions containing a detergent surfactant (anionic, nonionic, etc.), with a clay softener and a cationic antistatic agent, such as quaternary ammonium compound, quaternary diammonium compound, etc., are known in the art. Representative of the patent literature in this field are U.S. Pat. Nos. 3,862,058 (Nirschl, et al); 3,886,075 (Bernardino); 3,915,882 (Nirschl, et al.); 3,948,790 (Speakman); 4,203,851 (Ramachandran); U.K. Patent Application GB No. 2,141,152A (Ramachandron). Other patent art relating to clay fabric treating compositions include U.S. Pat. Nos. 3,594,212 (Ditsch) and 4,062,647 (Storm, et al.). The use of bentonites for softening textiles is known from British Pat. Nos. 401,413 and 461,221.

While satisfactory cleaning and softening performance has been achieved with the known clay softener-detergent compositions, it is generally difficult to achieve a reduction of static charge on laundered fabrics to a sufficiently high level so as to be perceivable by the ordinary consumer.

Generally, attempts to incorporate amounts of antistatic agent which would provide acceptable levels of antistatic performance have resulted in an overall reduction in cleaning, whitening and softening performance. This reduction in overall performance parameters has been observed whether the cationic antistatic agent is added to the formulation under conditions which would result in surface modification of the clay softener or under conditions which would merely result in physical mixtures of the clay, cationic antistatic agent, detergent and other components of the formulation.

Accordingly, it is an object of this invention to provide a clay softener detergent composition containing a static charge reducing compound.

Another object of the invention is to provide an antistatic laundry detergent composition in the form of spray-dried beads incorporating therein a water-soluble diammonium compound antistatic agent, wherein the spray-dried beads are compatible with clay mineral fabric softener, and a method for preparing the spray-dried beads.

It is another object of this invention to provide a built clay softener detergent powder composition having consumer perceivable antistatic properties without negatively impacting cleaning, whitening or softening performance of the composition.

Still another object of this invention is to provide a clay softener-detergent powder composition in which a water-soluble diammonium salt cationic antistatic agent can be added to the composition as a component of the crutcher mixture to be spray-dried whereby the antistatic agent can be uniformly and homogeneously incorporated into the composition, and the clay softener can be post-added to the spray-dried beads or granules.

These and other objects of the invention which will be more readily apparent from the following detailed description and preferred embodiments are achieved by using as the antistatic cationic compound in a clay-softener detergent laundry composition and particulately as a component of spray-dried beads or granules to be blended with the clay softener, a water-soluble diammonium salt of the formula (I):

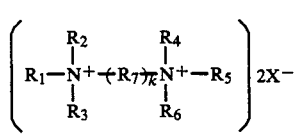

(I)

wherein $R_1$ is an aliphatic hydrocarbon having from about 12 to about 30 carbon atoms;

each of $R_2$, $R_3$, $R_4$, $R_5$ and $R_6$ are independently selected from the group consisting of aliphatic hydrocarbon groups having from 1 to 22 carbon atoms with the proviso that the total number of carbon atoms in all the aliphatic hydrocarbon groups, including $R_1$, is no more than about 75 and with the further proviso that no more than two of the $R_2$–$R_6$ groups have more than 12 carbon atoms; and hydroxyl groups of the formula

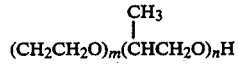

wherein m and n are independently 0 or positive numbers such that the sum of m and n from all of the groups $R_2$–$R_6$ is at least 2 but no more than 30; with the still further proviso that at least one of $R_2$–$R_6$ is said alkanol group;

$R_7$ is a divalent linking radical, such as $C_2$–$C_5$ lower alkylene or substituted $C_2$–$C_5$ lower alkylene, k is a number of from 1 to 20, and

X is a water-soluble salt forming anion.

Because the useful diammonium compounds of formula (I) are water-soluble and are also stable under a broad range of pH values and at elevated temperatures they can be added directly to the crutcher mix as a water solution with the other softener-detergent formulation ingredients to be spray-dried thereby uniformly and homogeneously incorporating the diammonium salt antistatic agents in the spray-dried granules or beads. As a result of this homogeneous distribution, the desired level of antistatic performance can be obtained using lower levels of the antistatic compound and without negatively effecting other detergent properties, including cleaning performance, whitening performance and softening performance.

As used herein and in the appended claims, the term "water-soluble" means that the antistatic diammonium compounds are soluble or at least form stable dispersions in water of at least 5% by weight at 20° C. The preferred compounds of formula (I) are soluble in water at ambient temperature to an extent of at least 10% by weight. Since the diammonium salt antistatic agents of formula (I) are available or can be prepared as organic solvent-free aqueous solutions or dispersions they can be easily and safely handled in powder processing plants and can be readily crutched and spray-dried as a component of heavy duty built granular or powdery laundry detergent compositions.

A typical heavy duty built formulation incorporating the spray-dried beads containing therein the water-soluble antistatic agent of formula (I) may include the following ingredients:

| Ingredients | Amount (Weight %) Total Composition | Spray-Dried Beads |
|---|---|---|
| detergent surface-active compound | 1–95 | 10–60 |
| organic and inorganic detergent builders | 2–80 | 5–90 |
| Clay softener | 1–50 | 0 |
| antistatic agent of formula (I) | 0.2–5 | 0.4–15 |
| fillers | 0–25 | 0–10 |
| bleach and bleach additives | 0–25 | 0–5 |
| optical brighteners, pigments, dyes | 0–10 | 0–8 |
| anti-foaming agents; suds suppressors, etc. | 0–10 | 0–8 |
| enzymes | 0–5 | 0 |
| pH adjusting agents, buffers, etc. | 0–10 | 0–8 |
| pH adjusting agents, buffers, etc. | 0–5 | 0–3 |
| antiredeposition agent, perfume, etc. | | |
| water | balance | |

In a preferred method for preparing the heavy duty built granular or powdery softener-detergent composition the antistatic agent of formula (I) and the remaining pH insensitive, heat stable ingredients will be mixed in a crutcher and spray-dried to form spray-dried beads and these beads will be uniformly mixed or over-sprayed with the ingredients of the formulation which are pH sensitive and/or heat sensitive or which may otherwise react with cationic antistatic agent, anionic surfactant or other component of the spray-dried beads or granules. As examples of the post-added ingredients to be mixed with the spray-dried beads, mention may be made of, for example, bleach, clay softener, enzymes, perfume, nonionic surfactant, etc. Formulation compounding procedures are well known in the art and the practitioner will be able to readily determine the optimum formulating conditions.

Synthetic Organic Detergent Compounds

The laundry detergent compositions may contain one or more surface active agents selected from the group consisting of anionic, nonionic, ampholytic and zwitterionic detergents. The synthetic organic detergents employed in the practice of the invention may be any of a wide variety of such compounds which are well known and are described at length in the text "Surface Active Agents and Detergents," Vol. II, by Schwartz, Perry and Berch, published in 1958 by Interscience Publishers, the relevant disclosures of which are hereby incorporated by reference. The total amount of the surface-active detergent compound or compounds can be as much as 95% by weight of the total detergent composition, although more preferred amounts are in the range of from about 1 to 70% by weight, especially 5 to 50% by weight, and especially preferably from about 5 to 30% by weight of the total detergent composition.

The detergent compositions of the present invention preferably employ one or more anionic detergent compounds as the primary surfactants. The anionic detergent may be supplemented, if desired, with another type of surfactant, preferably nonionic detergent, especially when used in combination with a detergent builder salt.

Anionic Surfactants

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulphonate, sulphate, carboxylate, phosphonate and phosphate so as to form a water-soluble detergent.

Examples of suitable anionic detergents include soaps, such as, the water-soluble salts (e.g. the sodium, potassium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also include the water-soluble sulphated and sulphonated detergents having an aliphatic, preferably an alkyl, radical containing from about 8 to 26, and preferably from about 12 to 22 carbon atoms. (The term "alkyl" includes the alkyl portion of the higher acyl radicals.) Examples of the sulphonated anionic detergents are the higher alkyl mononuclear aromatic sulphonates, such as the higher alkyl benzene sulphonates containing from about 10 to 16 carbon atoms in the higher alkyl group in a straight or branched chain, such as, for example, the sodium, potassium and ammonium salts of higher alkyl benzene sulphonates, higher alkyl toluene sulphonates and higher alkyl phenol sulphonates.

Other suitable anionic detergents are the olefin sulphonates including long chain alkene sulphonates, long chain hydroxylalkane sulphonates or mixtures of alkene sulphonates and hydroxyalkane sulphonates. The olefin sulphonate detergents may be prepared in a conventional manner by the reaction of sulphur trioxide ($SO_3$) with long chain olefins containing from about 8 to 25, and preferably from about 12 to 21 carbon atoms, such olefins having the formula $RCH{=}CHR^1$ wherein R represents a higher alkyl group of from about 6 to 23 carbons and $R^1$ represents an alkyl group containing from about 1 to 17 carbon atoms, or hydrogen to form a mixture of sultones and alkene sulphonic acids which is then treated to convert the sultones to sulphonates. Other examples of sulphate or sulphonate detergents are paraffin sulphonates containing from about 10 to 20 carbon atoms, and preferably from about 15 to 20 carbon atoms. The primary paraffin sulphonates are made by reacting long chain alpha olefins and bisulphites. Paraffin sulphonates having the sulphonate group distributed along the paraffin chain are shown in U.S. Pat. Nos. 2,503,280; 2,507,088; 3,260,741; 3,372,188 and German Patent No. 735,096.

Other suitable anionic detergents are sulphated ethoxylated higher fatty alcohols of the formula $RO(C_2H_4O)_mSO_3M$, wherein R represents a fatty alkyl group of from 10 to 18 carbon atoms, m is from 2 to 6 (preferably having a value from about 1/5 to ½ the number of carbon atoms in the R group) and M is a solubilizing salt-forming cation, such as an alkali metal, ammonium, lower alkylamino or lower alkanolamino, or a higher alkyl benzene sulphonate wherein the higher alkyl group is of 10 to 15 carbon atoms. The proportion of ethylene oxide in the polyethoxylated higher alkanol sulphate is preferably 2 to 5 moles of ethylene oxide groups per mole of anionic detergent, with three moles being most preferred, especially when the higher alkanol is of 11 to 15 carbon atoms. To maintain the desired hydrophilelipophile balance, when the carbon atom content of the alkyl chain is in the lower portion of the 10 to 18 carbon atoms range, the ethylene oxide content of the detergent may be reduced to about two moles per mole whereas when the higher alkanol is of 16 to 18 carbon atoms in the higher part of the range, the number of ethylene oxide groups may be increased to 4 or 5 and in some cases to as high as 8 to 9. Similarly, the salt-forming cation may be altered to obtain the best solubility. It may be any suitably solubilizing metal or radical but will most frequently be an alkali metal, e.g. sodium, or ammonium. If lower alkylamine or alkanolamine groups are utilized, the alkyl groups and alkanols will usually contain from 1 to 4 carbon atoms and the amines and alkanolamines may be mono-, di- and tri-substituted, as in monoethanolamine, di-isopropanolamine and trimethylamine. A preferred polyethoxylated alcohol sulphate detergent is available from Shell Chemical Company and is marketed as Neodol (Registered Trademark) 25-3S.

The most highly preferred water-soluble anionic detergent compounds are the ammonium and substituted ammonium (such as mono-, di- and tri-ethanolamine), alkali metal (such as, sodium and potassium) and alkaline earth metal (such as, calcium and magnesium) salts of the higher alkyl benzene sulphonates, olefin sulphonates and higher alkyl sulphates. Among the above-listed anionics, the most preferred are the sodium linear alkyl benzene sulphonates (LABS), and especially those wherein the alkyl group is a straight chain alkyl radical of 12 or 13 carbon atoms.

The anionic surfactant will generally constitute the major detergent component and may comprise from about 30 to 100% of the total surface active ingredients. Preferably the anionic accounts for at least 50%, preferably at least 60%, especially preferably at least 70%, and up to about 99%, preferably up to about 90%, especially preferably up to about 80% of the total surfactant detergent ingredients.

The anionic surfactant compound will usually and preferably be included as a component of the antistatic containing spray-dried beads and will be added to the crutcher mix as an aqueous solution or dispersion, and preferably as a highly concentrated aqueous slurry.

Nonionic Surfactants

The next most preferred class of surfactant detergent ingredient is the nonionic synthetic organic detergent compounds.

The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergent employed is preferably a poly-lower alkoxylated higher alkanol wherein the alkanol has 8 to 22 carbon atoms, preferably 10 to 18 carbon atoms, and wherein the number of moles of lower alkylene oxide (of 2 or 3 carbon atoms) is from 3 to 20. Of such materials it is preferred to employ those wherein the higher alkanol is a higher fatty alcohol of 11 to 15 carbon atoms and which contain from 5 to 13 lower alkoxy groups per mole. Preferably, the lower alkoxy group is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 7 ethylene oxide groups per mole, e.g. Neodol (Registered Trademark) 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups per mole averages about 6.5. The higher alcohols are primary alkanols. Other examples of such detergents include Tergitol (Registered Trademark) 15-2-7 and Tergitol 15-5-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product but with nine moles of ethylene oxide being reacted.

Highly preferred nonionics useful in the present compositions are the higher molecular weight nonionic detergents, such as Neodol 45-11, which are similar ethylene oxide condensation products of higher fatty aclohols, the higher fatty alcohol being of 14 to 15 carbon atoms and the number of ethylene oxide groups per mole being about 11. Such products are also made by Shell Chemical Company.

Of the total surface-active detergent ingredients in the detergent composition, the nonionic surfactant may be present in amounts of up to about 70% by weight, preferably up to about 50%, more preferably up to about 40% and especially preferably up to about 15%. Usually, the nonionic surfactant when used will be present in amounts of at least 1%, preferably at least 10%, especially preferably at least 30% of the combined weights of all of the surface-active detergent ingredients. In terms of the total softener-detergent composition, the nonionic surfactant compound will usually be present in amounts within the range of from about 0.1 to 20%, preferably 0.3 to 15%, especially preferably 0.6 to 10%, by weight.

Since the nonionic surfactant compounds are often only sparingly soluble in water or form viscous solutions or gels when added to water they are usually made available in the form of organic solvent solutions, for example, in ethanol or isopropanol, alone or together with water. Accordingly, when the nonionic surfactant compound is obtained in the form of its organic solvent solution, it will not be included as part of the crutcher mix used to form the spray-dried granules or beads, but rather, will be post-added to the already-formed spray-dried beads. Moreover, even where the nonionic surfactant compound is used in its pure liquid form (most of the nonionics being liquid at ambient temperatures) or as an aqueous solution, it is still preferred to post-add the nonionic surfactant compound to the spray-dried beads.

Zwitterionic detergents such as the betaines and sulphobetaines having the following formula are also useful:

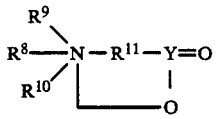

wherein $R^8$ represents an alkyl group containing from about 8 to 18 carbon atoms, $R^9$ and $R^{10}$ each independently represent an alkyl or hydroxyalkyl group containing about 1 to 4 carbon atoms, $R^{11}$ represents an alkylene or hydroxyalkylene group containing 1 to 4 carbon atoms, and Y represents a carbon atom or an S:O group. The alkyl group can contain one or more intermediate linkages such as amido, ether, or polyether linkages or nonfunctional substituents, such as hydroxyl or halogen which do not substantially affect the hydrophobic character of the group. When Y represents a carbon atom, the detergent is called a betaine; and when Y represents an S:O group, the detergent is called a sulphobetaine or sultaine.

Ampholytic detergents are also suitable for the invention. Ampholytic detergents are well known in the art and many operable detergents of the class are disclosed by Schwartz, Perry and Berch in the aforementioned "Surface Active Agents and Detergents". Examples of suitable amphoteric detergents include: alkyl betaminodipropionates, $RN(C_2H_4COOM)_2$; alkyl beta-amino propionates, $RN(H)C_2H_4COOM$; and long chain imidazole derivatives having the general formula

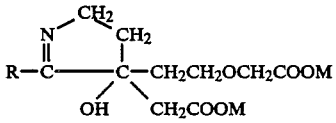

wherein in each of the above formulae R represents an acyclic hydrophobic group containing from about 8 to 18 carbon atoms and M is a cation to neutralize the charge of the anion. Specific operable amphoteric detergents include the disodium salt of undecylcycloimidinium-ethoxyethionic acid-2-ethionic acid, dodecyl beta alanine, and the inner salt of 2-trimethylamino lauric acid.

The amounts of the zwitterionic synthetic organic detergent and the ampholytic synthetic organic detergent when present in the invention compositions are not particularly critical and can be selected depending on the desired results. Generally, either or both of these classes of detergent ingredients can be used to replace all or part of the anionic organic detergent surfactant and/or nonionic organic detergent surfactant within the ranges disclosed above.

As with the anionic and nonionic surfactant compounds, the practitioner will be readily able to determine whether to include the zwitterionic and ampholytic surfactant as a component of the crutcher mix used to form the spray-dried beads or granules or to post-add these compounds to the spray-dried beads to form the final heavy duty built laundry detergent composition. Briefly, when available as water solutions, they will preferably be added to the crutcher mix and when available in organic solvents, they will be post-added to the spray-dried beads.

Clay Softener Compounds

The clay softener may be selected from any of the clay softeners known in the art to impart softness to fabrics laundered therewith. The preferred clays are smectite clay materials.

The smectite-type clays useful in the present invention are three-layer clays characterized by the ability of the layered structure to increase its volume several-fold by swelling or expanding when in the presence of water to form a thixotropic gelatinous substance. There are two distinct classes of smectitetype clays: in the first class, aluminum oxide is present in the silicate crystal lattice; in the second class, magnesium oxide is present in the silicate crystal lattice. Atom substitution by iron, magnesium, sodium, potassium, calcium and the like can occur within the crystal lattice of the smectite clays. It is customary to distinguish between clays on the basis of their predominant cation. For example, a sodium clay is one in which the cation is predominantly sodium.

The smectite clays used in the compositions herein are all commercially available. Such clays include, for example, montmorillonite, volchonskoite, nontronite, hectorite, saponite, sauconite, and vermiculite. These clays are available under various tradenames, for example, Thixogel No. 1 (also, "Thixo-Jel") and Gelwhite GP from Georgia Kaolin Co., Elizabeth, N.J.; Volclay BC and Volclay No. 325, from American Colloid Co., Skokie, Ill. It is to be recognized that such smectite-type minerals obtained under the foregoing tradenames can comprise mixtures of the various discrete mineral entities. Such mixtures of the smectite minerals are suitable for use herein.

In the compositions of the present invention, the most preferred of the clay softeners are the aluminum silicates, wherein sodium is the predominate cation, such as, for example, bentonite clays. Among the bentonite clays, those from Wyoming (generally referred to as western or Wyoming bentonite) are especially preferred.

Preferred swelling bentonites are sold under the trademark Mineral Colloid, as industrial bentonites, by Benton Clay Company, an affiliate of Georgia Kaolin Co. These materials which are the same as those formerly sold under the trademark THIXO-JEL, are selectively mined and beneficiated bentonites, and those considered to be most useful are available as Mineral Colloid Nos. 101, etc., corresponding to THIXO-JEL's Nos. 1, 2, 3, and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve (which has openings 74 microns across). More preferably, the bentonite is one wherein essentially all of the particles (i.e. at least 90% thereof, preferably over 95%) pass through a No. 325 sieve (U.S. Sieve Series) (which has openings 44 microns across) and most preferably all the particles pass through such a sieve. The swelling capacity of the bentonites in water is usually in the range of 3 to 15 ml/gram, and its viscosity, at a 6% concentration in water, is usually from about 8 to 30 centipoises.

Instead of utilizing the THIXO-JEL or Mineral Colloid bentonites one may employ products, such as that sold by American Colloid Company, Industrial Division, as General Purpose Bentonite Powder, 325 mesh, which has a minimum of 95% thereof finer than 325 mesh or 44 microns in diameter (wet partice size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis, on an "anhydrous" basis, is 63.05% silica, 21.5% alumina, 3.3% of ferric ion (as $Fe_2O_3$), 0.4% of ferrous iron (as FeO), 2.7% of magnesium (as MgO), 2.6% of sodium and potassium (as $Na_2O$), 0.7% of calcium (as CaO), 5.6% of crystal water (as $H_2O$) and 0.7% of trace elements.

Although the western bentonites are preferred, it is also possible to utilize other bentonites, such as those which may be made by treating Italian or similar bentonites containing relatively small proportions of exchangeable monovalent metals (sodium and potassium) with alkaline materials, such as sodium carbonate, to increase the cation exchange capacities of such products. It is considered that the $Na_2O$ content of the bentonite should be at least about 0.5%, preferably at least 1% and more preferably at least 2% so that the clay will be satisfactorily swelling, with good softening and dispersing properties in aqueous suspension. Preferred swelling bentonites of the types described above are sold under the tradenames Laviosa and Winkelmann, e.g. Laviosa AGB and Winkelmann G-13.

Naturally, any other clay minerals which are substantive to and are capable of imparting "softness" to textile materials can be used in the present invention.

The preferred clays used herein are "impalpable", i.e. have a particle size which cannot be perceived tactilely. Impalpable clays have particle sizes below about 50 microns; the clays used herein have a particle size range of from about 5 microns to about 50 microns.

The clay softener compounds are present in the detergent compositions at levels of from about 1 to about 50 percent, preferably from about 2 to 30%, especially preferably from about 4 to 20%, by weight, based on the total composition.

In the present invention, it is highly preferred that the clay softener be post-added to the antistat-containing spray-dried beads or granules so as to avoid any interaction, e.g. ion-exchange, between the clay mineral particles and the cationic diammonium compound antistatic agent. Thus, since the diammonium compound is homogeneously and very finely distributed throughout the spray-dried beads as a result of the crutching and spray-drying operations and since the post-added ingredients contact the spray-dried beads under substantially anhydrous conditions there will be substantially no ion-exchange between the clay softener and cationic diammonium salt antistatic agent.

The clay softener is present in the invention detergent compositions in an amount sufficient to provide the desired softening effect when the composition is used in conventional amounts for laundry detergent compositions, e.g. from about ⅛ to 1½ cups of detergent per load of wash.

Detergent Builders

The detergent compositions of the invention optionally, but preferably, contain at least one detergent builder of the type commonly used in detergent formulations. Useful builders include any of the conventional inorganic water-soluble builder salts, such as, for example, water-soluble salts of phosphates, pyrophosphates, orthophosphates, polyphosphates, tripolyphosphates, silicates, carbonates, bicarbonates, borates, sulfates, and the like. Organic builders include water-soluble phosphonates, polyphosphonates, polyhydroxysulphonates, polyacetates, aminopolyacetates, carboxylates, polycarboxylates, succinates, phytates, and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. Nos. 3,213,030; 2,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium acetates, carboxylates, polycarboxylates and polyhydroxysulphonates are useful builders for the compositions and processes of the present invention. Specific examples of acetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-)acids, carboxymethoxysuccinic acid and citric acid.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, are also suitable herein.

Water-insoluble builders may also be used, particularly, the complex silicates and more particularly, the complex sodium alumino silicates such as, zeolites, e.g. zeolite 4A, a type of zeolite molecule wherein the univalent cation is sodium and the pore size is about 4 Å. The preparation of such type of zeolite is described in U.S. Pat. No. 3,114,603. The zeolites may be amorphous or crystalline and have water of hydration as known in the art.

Mixtures of organic and/or inorganic builders can be used herein. One such mixture of builders is disclosed in Canadian Patent No. 755,038, e.g. a ternary mixture of sodium tripolyphosphate, trisodium nitrilotriacetate and trisodium ethane-1-hydroxy-1,1-diphosphonate. It is to be understood that while the alkali metal salts of the foregoing inorganic and organic polyvalent anionic builder salts are preferred for use herein from an economic standpoint, the ammonium, alkanolammonium, e.g. triethanol ammonium, diethanol ammonium, and the like, water-soluble salts of any of the foregoing builder anions are useful herein.

The builder salts, including both the inorganic and organic detergent builder salts are conveniently added to the crutcher mix to be included with the antistatic diammonium compound antistatic agent, anionic surfactant, etc., in the invention spray-dried beads or granules to provide from about 5 to about 90%, preferably from about 15 to 65%, especially preferably from about 20 to 55%, by weight, of builder salts based on the weight of the spray-dried beads so as to provide in the finished composition, after mixing with the post-added ingredients, from about 2 to 80%, preferably 10 to 70%, and especially preferably 20 to 50% of detergent builder salt(s), based on the total composition.

Diammonium Compound Antistatic Agent

The antistatic agent compounds used in the present invention are diammonium compounds which are characterized by their water-solubility, i.e. ability to form stable, clear solutions, or dispersions in water at 25° C. containing at least 5%, preferably at least 10%, by weight of the diammonium compound.

The diammonium compounds useful herein for reducing static charge buildup are the water-soluble compounds of the following general formula (I)

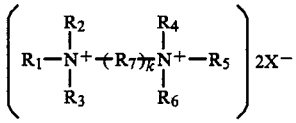

(I)

wherein $R_1$ is an aliphatic hydrocarbon having from about 12 to about 30 carbon atoms;

each of $R_2$, $R_3$, $R_4$, $R_5$ and $R_6$ are independently selected from the group consisting of aliphatic hydrocarbon groups having from 1 to 22 carbon atoms with the proviso that the total number of carbon atoms in all the aliphatic hydrocarbon groups, including $R_1$, is no more than about 75 and with the further proviso that no more than three of the $R_2$–$R_6$ groups have more than 12 carbon atoms; and alkanol groups of the formula $$(CH_2CH_2O)_m(\overset{CH_3}{\overset{|}{C}}HCH_2O)_nH$$

wherein m and n are independently 0 or positive numbers with the sum of m and n from all of the groups $R_2$–$R_6$ being at least 2 but no more than 30; with the still further proviso that at least one of $R_2$–$R_6$ is said alkanol group;

$R_7$ is a divalent linking radical, such as $C_2$–$C_5$ lower alkylene or substituted $C_2$–$C_5$ lower alkylene, k is a number of from 1 to 20, and X is a water-soluble salt forming anion.

The preferred compounds of formula (I) are those containing only 1 or 2, preferably only a single long carbon chain group, i.e. 12 or more carbon atoms. Accordingly, in formula (I) the preferred definitions for $R_1$–$R_6$ are:

$R_1$ is an aliphatic hydrocarbon group, which may be straight chain or branched chain, and saturated or unsaturated (i.e. linear or branched alkyl, alkenyl or alkynyl), having from 16 to 22 carbon atoms;

$R_2$–$R_6$, independently, are selected from the group consisting of alkyl or alkenyl having from 1 to 16, preferably 1 to 12, especially preferably 1 to 6 carbon atoms, with the proviso that the total number of carbon atoms in all the aliphatic hydrocarbon groups $R_1$–$R_6$ is no more than about 50, preferably no more than about 35, and with the further proviso that no more than 2, preferably no more than 1, and most preferably none of $R_2$–$R_6$ have more than 12 carbon atoms; and alkanol groups of the formula $$(CH_2CH_2O)_m(CH(CH_3)CH_2CH_2O)_nH$$

wherein m and n may be 0 or a positive number such that the sum of m plus n in all of the alkanol groups $R_2$–$R_6$ is at least 3 but no more than 25, preferably no more than 15, with the still further proviso that at least one, preferably at least two of $R_2$–$R_6$ is said alkanol group:

$R_7$ is an alkylene of 2 to 4 carbon atoms, such as ethylene ($—CH_2CH_2—$), propylene ($—CH_2CH_2CH_2-$), isopropylene ($—CH_2CH(CH_3)CH_2—$), butylene ($—CH_2CH_2CH_2CH_2—$), etc., or such alkylene having one or more, such as one or two, substituents, such as hydroxyl, $C_1$–$C_4$ lower alkyl, hydroxylower ($C_1$–$C_4$) alkyl, etc., preferably $—CH_2CH_2—$ or $—CH_2CH_2CH_2—$, most preferably $—CH_2CH_2CH_2—$ k is from 1 to 10, preferably 1 to 5, especially preferably 1 to 3; and X is a water-soluble salt-forming anion, such as, for example, halide, e.g. bromide, chloride or iodide, sulfate, methosulfate, ethosulfate, hydroxide, acetate, propionate, or other similar inorganic or organic solubilizing monovalent anion. Examples of preferred $R_1$ groups include stearyl, tallow, hydrogenated tallow, eicosyl, soya, and the like.

Examples of preferred alkyl and alkenyl groups for $R_2$ to $R_6$ include, methyl, ethyl, propyl, isopropyl, n-butyl, tert.butyl, n-butenyl, octyl, 1-octenyl, etc. Methyl, ethyl, propyl and isopropyl are especially preferred. Methyl and ethyl are most preferred.

Examples of preferred alkanol groups for $R_2$ to $R_6$ include ethanol (n=0, m=1); propanol (m=0, n=1) and ethoxy-, propoxy-, and mixed (ethoxy)(propoxy) ethanol and/or propanol, such as $(CH_2CH_2O)_{m1}H$, where $m^1$ is from 2 to 4;

$$\left(\begin{matrix}CHCH_2O\\ |\\ CH_3\end{matrix}\right)_{n1} H$$

where $n^1$ is 2 to 4, and $(CH_2CH_2O)_{m1}(CH(CH_3)CH_2O)_{n1}$, where $m^1$ and $n^1$ are each numbers of from 1 to 4 and $m^1+n^1=2$ to 6. In the mixed ethoxy-propoxy alkanol groups, the order of addition of the ethoxy and propoxy groups is not critical and it is understood that either blocks of the ethoxy groups or blocks of the propoxy groups can be bonded to the N-atom of the diammonium compound or that the ethoxy and propoxy groups may be randomly distributed. Thus, as is well known in the art, the distribution of the ethoxy and propoxy groups will be determined by the order in which the ethylene diamine or propylene diamine compound is condensed with ethylene oxide (or its precursor) and propylene oxide (or its precursor).

Specific examples of compounds of formula (I) which are either commercially available or readily manufactured by customary techniques include (1)

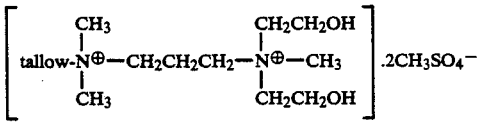

(2)

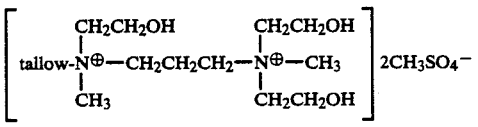

(3)

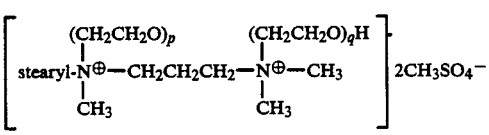

p + q = 2 to 10

(4)

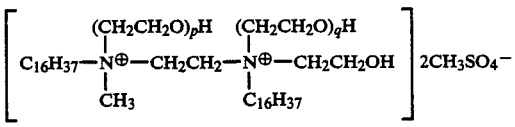

p + q = 2 to 10

(5)

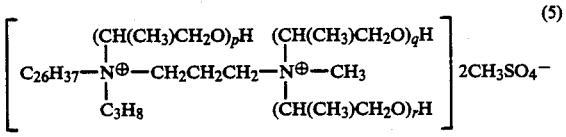

p + q + r = 3 to 15 etc. and the corresponding ethosulfate, halide, acetate, etc., water-soluble salts.

The above compound (2) N-methyl-N-(2-hydroxyethyl)N-tallowalkyl-N'-methyl-N'-bis(2-hydroxyethyl)-propylenediammonium methylsulfate is especially preferred. This compound is commercially available as Rewoquat DQ35 from Rewo Chemicals Co. of Germany and is a clear liquid solution with 35% solids dissolved therein. Rewoquat DQ35 has a free amine content of less than 2% by weight and has a pH (1% solution in water) in the range of from 3.5 to 5. This compound can be prepared in customary manner, for example, by reacting 1 mole of N-methyl-N-tallowalkyl-N'-methyl propylene diamine with 3 moles ethylene oxide and then quaternizing the resulting compound with methylsulfate. By ethoxylating with more than 3 moles ethylene oxide, the corresponding higher ethoxylated compounds can be prepared.

It is a critical feature of the present invention that the diammonium salt antistatic agent has the specified degree of water solubility but not be so water soluble as to be only difficultly exhaustible from the washing liquor during use of the detergent-softener composition. Generally, a degree of solubility up to about 50% by weight at 25° C. is sufficient to provide the required static charge reducing capability on laundered fabrics.

The aqueous (organic solvent-free) solution (or dispersion) of the diammonium salt antistatic agent is add to the crutcher mix together with the remaining pH insensitive and heat stable ingredients, such as builder(s), fillers, anionic surfactant, pH adjusting agent, water, etc., and the mixture is then spray-dried according to customary techniques. The amount of the antistatic agent in the crutcher mix is such that the spray-dried beads or granules will contain from about 0.4 to 15%, preferably from 1 to 12%, especially preferably from about 2 to 12%, by weight of the beads, of the antistatic agent compound of formula (1). The antistatic agent is finely distributed completely homogeneously in the spray-dried beads and can most effectively exhibit its antistatic function without interfering with the other functional ingredients.

The antistat-containing spray-dried beads are then intimately mixed with the clay softener and remaining ingredients, e.g. nonionic surfactant, bleach, enzymes, perfumes and other pH or heat sensitive and/or water-insoluble ingredients to prepare the final softener-detergent-antistatic agent composition. The amount of the spray-dried beads and post-added ingredients is such that the final composition has the following amounts of the essential ingredients:

| Ingredient | Amount (wt %) Broad | Intermediate | Preferred |
|---|---|---|---|
| Detergent | 1–95 | 5–50 | 5–30 |
| Builders | 2–80 | 10–70 | 20–50 |
| Clay Softener | 1–50 | 2–30 | 4–20 |
| Diammonium Salt (Compound of formula (I)) | 0.2–5 | 0.4–3 | 0.5–2.5 |
| Detergent Additives, Fillers Moisture | 0–60 | 2–50 | 5–30 |

The balance of the composition, if any, will be filled by the conventional detergent additives, fillers, and moisture.

Optional Components

The use of an inert, water-soluble filler salt is desirable in the laundering compositions of the invention. A preferred filler salt is an alkali metal sulphate, such as, potassium or sodium sulphate, the latter being especially preferred. The amount of filler will generally be up to about b 5%, such as 0.1 to 2%, preferably 0.3 to 1%, by weight of the composition.

Various adjuvants may be included in the laundry detergent compositions of the present invention. In general, these include perfumes, colorants, e.g. pigments and dyes; bleaches, such as sodium perborate, bleach activators, bleach stabilizers, antiredeposition or soil suspending agents, such as, alkali metal salts of carboxymethylcellulose; optical brighteners, such as, anionic, cationic or nonionic brighteners; foam stabilizers, such as, alkanolamides, foam boosters, germicides, antitarnshing agents, pH adjusting agents, enzymes and the like, all of which are well-known in the fabric washing art for use in detergent compositions. Flow promoting agents, commonly referred to as flow aids, may also be employed to maintain the particulate compositions as free-flowing beads or powder. Starch derivatives and special clays are commercially available as additives which enhance the flowability of otherwise tacky or pasty particulate compositions, two of such clay additives being presently marketed under the tradenames "Satintone" and "Microsil." Bound water and free water in minor amounts which do not adversely effect the flowability of the granular or powdery compositions may also be present in the detergent compositions. Amounts of moisture will normally be from 1 to 15%, preferably 5 to 12%, most preferably 8 to 12% of the entire composition. Within these proportions, a satisfactorily flowing particulate, pulverulent or granular product results; which, by control of particulate size and moisture content, can be prevented from being excessively dusty.

Suitable ranges of the detergent additives are: enzymes—0 to 2%, especially 0.2 to 1%; corrosion inhibitors—about 0 to 15%, and preferably 2 to 8%; antifoam agents and suds-suppressors—0 to 15%, preferably 0 to 8%, for example 0.1 to 5%; soil suspending or antiredeposition agents and anti-yellowing agents—0 10%, preferably 0.3 to 3%; colorants, perfumes, brighteners and bluing agents total weight 0% to about 2% and preferably 0% to about 1%, such as 0.2 to 0.8%; pH modifiers and pH buffers—0 to 5%, preferably 0 to 2%; bleaching agent—0% to about 40% and preferably 0% to about 25%, for example, 2 to 20%; bleach stabilizers and bleach activators 0 to about 15%, preferably 0 to 10%, for example, 0.1 to 8%. In the selections of the adjuvants, they will be chosen to be compatible with the main constituents of the detergent composition.

Whatever the form of the laundry detergent, its use in the washing process is essentially the same. The particulate composition is usually added to wash water in an automatic washing machine so that the concentration thereof in the wash water may range from about 0.05 to 1.5%, usually 0.1 to 1.2%. The water to which it is added will preferably be of medium or low hardness, e.g. from 30 to 120 parts per million of hardness, as calcium carbonate, but both softer and harder waters may be usefully employed. The water temperature can be from 20° C. to 100° C. and is preferably from 60° to 100° C. in those cases where the textile or laundry is capable of withstanding high temperatures without deterioration or fading of dyes. When low temperature laundering is desired, the temperature may be held at 20° to 40° C.

At the concentrations of detergent composition mentioned, the pH of the wash water will usually be on the alkaline side, for example, from 7 to 12, preferably from 8 to 11, especially from 9 to 10. The laundry:wash water weight ratio will usually be from about 1:4 to 1:30, preferably 1:10 to 1:30.

The following examples illustrate, but do not limit the invention. Unless otherwise indicated, all parts and percents are by weight.

EXAMPLE 1

The following composition is prepared by first forming the spray-dried beads (A) and then post-adding the components (B).

| | Parts |
|---|---|
| "A" (Spray-dried Beads) | |
| Tap Water | 6.8 |
| Hydrogenated fish oil or tallow oil fatty acids | 2.8 |
| NaOH (35.7%) | 1.3 |
| Tap Water | 11.5 |
| Sodium Silicate (40%) $Na_2O:SiO_2$) | 9.9 |
| Anionic Surfactant[1] | 16.0 |
| Optical Brightener[2] | 0.2 |
| Sodium Carboxymethyl cellulose | 0.7 |
| Pentasodium Tripolyphosphate | 36.4 |
| Rewoquat DQ35 (30% diammonium compound) | 4.7 |
| Sodium sulfate (anhydrous) | 0.7 |
| Total: | 91.0[3] |
| Post Added Ingredients (B) | |
| Sodium Perborate | 15.0 |
| Blue bentonite clay agglomerate | 16.0 |
| Enzyme | 0.5 |
| Magnesium silicate/DTPA mix No. 2 | 0.2 |
| Potassium Methyl Siliconate (50%) | 0.6 |
| Nonionic surfactant[4] | 3.0 |
| Duet 787 (perfume) | 0.5 |
| Spray dried beads (A) | 64.2 |
| Total | 100.0 |

[1]linear dodecyl benzene sulfonate - as aqueous slurry.
[2]Stilbene brightener No. 4, high conc. granule.
[3]64.2 parts after drying.
[4]$C_{14}$–$C_{15}$ fatty alcohol ethoxylated with 11 moles ethylene oxide per mole.

The concentration of the Rewoquat DQ35 antistatic agent in the final composition was 1.63%.

For comparison, the same composition was prepared except that the Rewoquat DQ35 was not used. Each of the compositions was tested for their static charge reducing capability on four different types of fabric: acrylic; polyester; polyester/cotton blend; and nylon.

In Table 1 below the results are reported for electrostatic charge values obtained by Bauman's instrumental method. In Table 2 below are reported the results of an independent expert of degree of static charge (0=no charge to 3=highly charged). All data are obtained after washing at 60° C. and drying at full dryer power in a Miele dryer for 40 minutes. The instrumental readings were taken after conditioning at 20° C. and 40% relative humidity. Also shown in Table 1 and 2 are the results for a second series of tests in which the invention composition was compared to a commercially available softener-detergent-antistat powder composition (tallow trimethyl ammonium chloride-2%, ditallow methylamine salt-4%.

TABLE 1

| | BAUMAN MEASUREMENTS (VOLTS)** | | | | | | | |
|---|---|---|---|---|---|---|---|---|
| | Acrylic | | Fabric Polyester | | Cotton Polyester | | Nylon | |
| Product | Run 1* | Run 2* | Run 1* | Run 2* | Run 1* | Run 2* | Run 1* | Run 2* |
| A + B (invention) | 275 | | 88 | | 35 | | 550 | |
| A + B without Rewoquat DQ35 (comparison) | 1038 | | 219 | | 81 | | 775 | |
| A + B (invention) | 538 | 438 | 350 | 131 | 225 | 131 | 475 | 600 |
| Commercial Product | 613 | 588 | 138 | 131 | 131 | 188 | 650 | 588 |

*Each run is based on the average value for a total of 9 washings
**The higher the voltage reading the higher the static charge buildup.

TABLE 2

JUDGE EVALUATION OF STATIC CHARGE

| Product | Acrylic Run 1* | Acrylic Run 2* | Polyester Run 1* | Polyester Run 2* | Polyester Cotton Run 1* | Polyester Cotton Run 2* | Nylon Run 1* | Nylon Run 2* | Full Load Run 1* | Full Load Run 2* |
|---|---|---|---|---|---|---|---|---|---|---|
| A + B (invention) | 0 | | 0 | | 0 | | 0/1 | | 0 | |
| A + B (without Rewoquat) | 2 | | 1 | | 0 | | 2 | | 2 | |
| A + B (invention) | 2 | 1 | 1 | 0 | 1 | 0 | 2 | 1 | 0/1 | 0 |
| Commercial Product | 2 | 2 | 1 | 2 | 0 | 0 | 2 | 2 | 0/1 | 0 |

*Each run is based on the average evaluation for a series of 9 washings.

The softening, cleaning and whitening evaluation of the invention composition (A+B) showed that there no negative effect on these performance parameters as compared to the formulation A+B without the Rewoquat DQ35 antistatic agent.

EXAMPLE 2

When in Example 1, the same amount of Rewoquat DQ35 as used in component A was used instead with the post-added component B, the static charge reducing capability was diminished.

EXAMPLE 3

Following the same general procedure as in Example 1, the following composition is prepared:

| | Wt % |
|---|---|
| Spray Dried Beads "A" | |
| Sodium tridecyl benzene sulphonate | 15.0 |
| Pentasodium Tripolyphosphate | 33.0 |
| Sodium Silicate ($1Na_2O:2.4SiO_2$) | 7.0 |
| Sodium sulfate | 4.0 |
| Optical Brightener (Tinopal 5BM) | 0.2 |
| Na carboxymethyl cellulose | 0.25 |
| Rewoquat DQ35 | 1.8 |
| NaOH (40%) | 1.75 |
| Subtotal | 63.0 |
| Post-Added "B" | |
| Thixogel No. 1 clay | 18.0 |
| Sodium Perborate | 14.0 |
| Enzyme | 0.5 |
| Potassium methyl siliconate | 0.6 |
| Nonionic surfactant[1] | 3.0 |
| Magnesium Silicate/DTPA Mix No. 2 | 0.3 |
| Duet 787 | 0.6 |
| Subtotal | 37.0 |
| Total | 100 |

[1]$C_{12}$–$C_{14}$ fatty alcohol condensed with 9 moles ethylene oxide per mole.

EXAMPLE 4

The following composition is prepared by following the same general procedure in Example 1:

| | Wt % |
|---|---|
| Spray-dried base beads "A" | |
| Anionic surfactant[1] | 16.6 |
| Sodium tripolyphosphate | 43.3 |
| Sodium silicate | 5.8 |
| Sodium sulfate | 10.0 |
| Rewoquat DQ35 | 2.0 |
| Na carboxymethyl cellulose | 0.3 |
| Subtotal | 80.0 |
| Post-added "B" | |
| Nonionic[2] | 6.0 |

-continued

| | Wt % |
|---|---|
| Optical Brightener | 0.2 |
| Enzyme | 0.6 |
| Perfume | 0.2 |
| Gelwhite GP | 13.0 |
| Subtotal | 20.0 |
| Total | 100.0 |

[1]1.22:1 ratio of sodium tallow alkyl sulfate: sodium dodecylbenzene sulfonate
[2]coconut alcohol ethoxylate (EO = 14:1).

What is claimed is:

1. A free-flowing powdery or granular laundry detergent and softener and antistatic composition which consists of (A) from about 1 to about 95% by weight of at least one detergent compound selected from the group consisting of anionic synthetic detergent, nonionic synthetic detergent, amphoteric synthetic detergent, zwitterionic synthetic detergent and mixtures thereof;

(B) from about 1 to about 50% by weight of at least one clay mineral fabric softener;

(C) from about 2 to about 80% by weight of at least one detergent builder;

(D) from about 0.2 to 5% by weight of at least one quaternary ammonium compound, said at least one quaternary ammonium compound being a water-soluble diammonium compound antistatic agent having the formula (I)

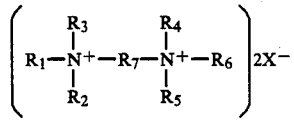

(I)

wherein $R_1$ is an aliphatic hydrocarbon having from about 12 to about 30 carbon atoms, each of $R_2$, $R_3$, $R_4$, $R_5$ and $R_6$ are independently selected from the group consisting of aliphatic hydrocarbon groups having from 1 to 22 carbon atoms with the proviso that the total number of carbon atoms in all the aliphatic hydrocarbon groups, including $R_1$, is no more than about 75 and with the further proviso that no more than three of the $R_2$–$R_6$ groups have more than 12 carbon atoms, and alkanol groups of the formula $$(CH_2CH_2O)_m(\underset{\underset{CH_3}{|}}{C}HCH_2O)_nH$$

wherein m and n are independently 0 or positive numbers with the sum of m and n from all of the groups $R_2$–$R_6$ being at least 2 but no more than 30, with the still further proviso that at least one of $R_2$–$R_6$ is said alkanol group, and $R_7$ is a divalent linking group of at least 2 but not more than 100 carbon atoms, and X is a water-soluble salt forming anion;

(E) form 0 to 2% by weight enzymes;

(F) from 0 to 15% by weight corrosion inhibitors;

(G) from 0 to 15% by weight anti-foam agents and suds suppressors;

(H) from 0 to 10% by weight soil suspending or antiredeposition agents and anti-yellowing agents;

(I) from 0 to 2% by weight colorants, perfumes, brighteners and bluing agents;

(J) from 0 to 5% by weight pH modifiers and pH buffers;

(K) from 0 to 40% by weight bleaching agent;

(L) from 0 to 15% by weight of bleach stabilizers and bleach activators; and (M) moisture, wherein said diammonium compound of formula (I) is present in the composition as a component of a spray-dried bead comprised of said diammonium compound, an anionic surfactant, detergent builder salt and, optionally, pH insensitive and heat stable detergent additives, fillers and mixtures thereof; and said at least one clay fabric softener is solely uniformly blended with said spray-dried beads.

2. The composition of claim 1 wherein the formula (I) $R_1$ is a linear or branched alkyl, alkenyl or alkynyl group having from 16 to 22 carbon atoms;

$R_2$–$R_6$, independently, are selected from the group consisting of alkyl or alkenyl having from 1 to 16 carbon atoms, with the proviso that the total number of carbon atoms in all the aliphatic hydrocarbon groups $R_1$–$R_6$ is no more than about 50, and with the further proviso that no more than 2 of $R_2$–$R_6$ have more than 12 carbon atoms, and alkanol groups of the formula $$(CH_2CH_2O)_m(\underset{\underset{CH_3}{|}}{C}HCH_2O)_nH$$

wherein m and n are, independently, 0 or a positive number such that the sum of m+n from all of the alkanol groups $R_2$–$R_6$ is at least 3 but no more than 25, with the proviso that at least one of the groups $R_2$ to $R_6$ is said alkanol group.

3. The composition of claim 2 wherein $R_2$–$R_6$, independently, are alkyl or alkenyl of from 1 to 6 carbon atoms or said alkanol groups with the provisos that the total number of carbon atoms in all of the aliphatic hydrocarbon groups $R_1$–$R_6$ is no more than about 35 and the sum of m+n from all of the alkanol groups $R_2$ to $R_6$ is no more than 15, and $R_7$ is $—CH_2CH_2—$ or $—CH_2CH_2CH_2—$.

4. The composition of claim 1 wherein the diammonium compound antistatic agent is $$\text{tallow-}\underset{\underset{CH_3}{|}}{\overset{\overset{C_2H_4OH}{|}}{N}}—CH_2CH_2CH_2—\underset{\underset{C_2H_4OH}{|}}{\overset{\overset{C_2H_4OH}{|}}{N}}—CH_3\ .2CH_3SO_4.$$

5. The composition of claim 1 wherein said at least one detergent compound comprises an anionic synthetic detergent and said at least one detergent builder comprises an inorganic polyphosphate builder salt.

* * * * *